US007040333B1

(12) United States Patent
Ransom et al.

(10) Patent No.: US 7,040,333 B1
(45) Date of Patent: May 9, 2006

(54) COLLAPSIBLE ENCLOSURE WITH INTERCHANGEABLE AND REVERSIBLE COVERING ELEMENTS

(76) Inventors: Robert M. Ransom, 8102 Coldwater Rd., Flushing, MI (US) 48433; Todd P. Weston, 7780 Pleasant La., Ypsilanti, MI (US) 48197; Ryan L. Kubica, 8470 Apple Blossom, Flushing, MI (US) 48433; Scott D. Wehner, 4407 W. Stanley Rd., Mt. Morris, MI (US) 48458

( * ) Notice: Subject to any disclaimer, the term of this patent is extended or adjusted under 35 U.S.C. 154(b) by 0 days.

(21) Appl. No.: 10/025,279

(22) Filed: Dec. 6, 2001

Related U.S. Application Data

(60) Provisional application No. 60/251,545, filed on Dec. 7, 2000.

(51) Int. Cl.
*E04H 15/00* (2006.01)
*F41H 3/02* (2006.01)

(52) U.S. Cl. ..... 135/126; 135/115; 135/901; 428/919; 43/1

(58) Field of Classification Search ..... 135/901, 135/115, 125, 126; 52/3, 63; 446/476, 478, 446/490; 428/919; 150/154, 166
See application file for complete search history.

(56) References Cited

U.S. PATENT DOCUMENTS

| | | | | |
|---|---|---|---|---|
| 2,057,942 | A | 10/1936 | Fay | |
| 2,142,301 | A * | 1/1939 | Buchalter | 428/542.6 |
| 2,879,533 | A | 2/1959 | Ward | |
| 3,502,091 | A | 3/1970 | Corbin | |
| 3,675,667 | A | 7/1972 | Miller | |
| 3,733,758 | A | 5/1973 | Maier et al. | |
| 3,807,421 | A | 4/1974 | Geiger et al. | |
| 3,813,801 | A * | 6/1974 | Vander Schaaf | 40/306 |
| 3,880,459 | A | 4/1975 | Kelley | |
| 3,960,161 | A | 6/1976 | Norman | |
| 3,987,580 | A | 10/1976 | Ausnit | |
| 3,990,463 | A | 11/1976 | Norman | |
| 4,067,346 | A * | 1/1978 | Husted | |
| 4,073,105 | A | 2/1978 | Daugherty | |
| 4,133,149 | A | 1/1979 | Angress | |
| 4,165,757 | A | 8/1979 | Marks | |
| 4,170,082 | A | 10/1979 | Freedman | |
| 4,197,681 | A * | 4/1980 | Holcombe | |
| 4,206,575 | A * | 6/1980 | Leonard | |
| 4,212,130 | A | 7/1980 | Walker | |
| 4,265,261 | A | 5/1981 | Barker | |
| 4,323,605 | A * | 4/1982 | Rush | 428/17 |
| 4,375,488 | A * | 3/1983 | Hogan | 428/17 |
| 4,607,655 | A * | 8/1986 | Wagner et al. | 52/2.19 |
| 4,635,411 | A | 1/1987 | Kurzen | |
| 4,709,718 | A * | 12/1987 | Nichols | |

(Continued)

FOREIGN PATENT DOCUMENTS

| | | |
|---|---|---|
| DE | 2015649 | 2/1971 |

(Continued)

*Primary Examiner*—Robert Canfield
(74) *Attorney, Agent, or Firm*—Young & Basile, P.C.

(57) ABSTRACT

The invention is a portable, collapsible enclosure for protection from the elements in an outdoor environment. The tent-like enclosure is provided with one or more fabric coverings each bearing at least one color or camouflage pattern. The coverings are easily removable from the enclosure, and may be reversible, bearing one color or camouflage pattern on one side, and a different color or camouflage pattern on the reverse side. In this fashion, the same portable enclosure can be made to present a variety of appearances, depending on which covering is attached to the enclosure, and which side of the attached covering is exposed or outermost.

7 Claims, 6 Drawing Sheets

U.S. PATENT DOCUMENTS 4,716,918 A 1/1988 Hayashida et al.
4,815,784 A 3/1989 Zheng
4,825,892 A 5/1989 Norman
4,858,634 A 8/1989 McLeese
4,951,333 A 8/1990 Kaiser et al.
5,010,909 A * 4/1991 Cleveland
5,024,262 A 6/1991 Huang
5,038,812 A 8/1991 Norman
5,054,507 A 10/1991 Sparks
5,062,234 A * 11/1991 Green
5,079,048 A * 1/1992 Anitole ..... 428/17
5,134,815 A 8/1992 Pickett
5,137,044 A 8/1992 Brady
5,163,608 A * 11/1992 Block ..... 229/92.8
5,222,513 A 6/1993 Hilliard
5,301,705 A 4/1994 Zheng
5,352,149 A * 10/1994 Melashenko et al.
5,377,711 A * 1/1995 Mueller ..... 135/87
5,394,897 A 3/1995 Ritchey et al.
5,411,046 A * 5/1995 Wan ..... 135/126
5,467,794 A 11/1995 Zheng
5,579,799 A 12/1996 Zheng
5,638,850 A * 6/1997 Hazinski et al.
5,664,596 A 9/1997 Zheng
5,816,279 A 10/1998 Zheng
5,842,495 A * 12/1998 Egnew et al. ..... 135/133
5,927,524 A * 7/1999 Miller ..... 215/11.6
6,010,176 A * 1/2000 Jones
6,021,794 A * 2/2000 Guerra
6,145,696 A * 11/2000 Duncan ..... 220/739
6,164,005 A * 12/2000 Copeland
6,202,666 B1 * 3/2001 Rehbein
6,341,713 B1 * 1/2002 Kilmer ..... 220/694
6,357,462 B1 * 3/2002 Laoosunthara et al. ..... 135/96
6,357,510 B1 * 3/2002 Zheng
6,390,110 B1 * 5/2002 Brown ..... 135/93
6,408,865 B1 * 6/2002 Bliss
2002/0059970 A1 * 5/2002 Lemieux
2002/0069904 A1 * 6/2002 Robinson
2002/0088564 A1 * 7/2002 Zheng
2003/0024559 A1 * 2/2003 Fileds
2003/0098108 A1 * 5/2003 Littlefield ..... 150/106

FOREIGN PATENT DOCUMENTS

DE 3013178 11/1981
DE 4114916 A1 1/1993
FR 1380738 12/1964
FR 2635136 2/1990
GB 1015273 12/1965

* cited by examiner

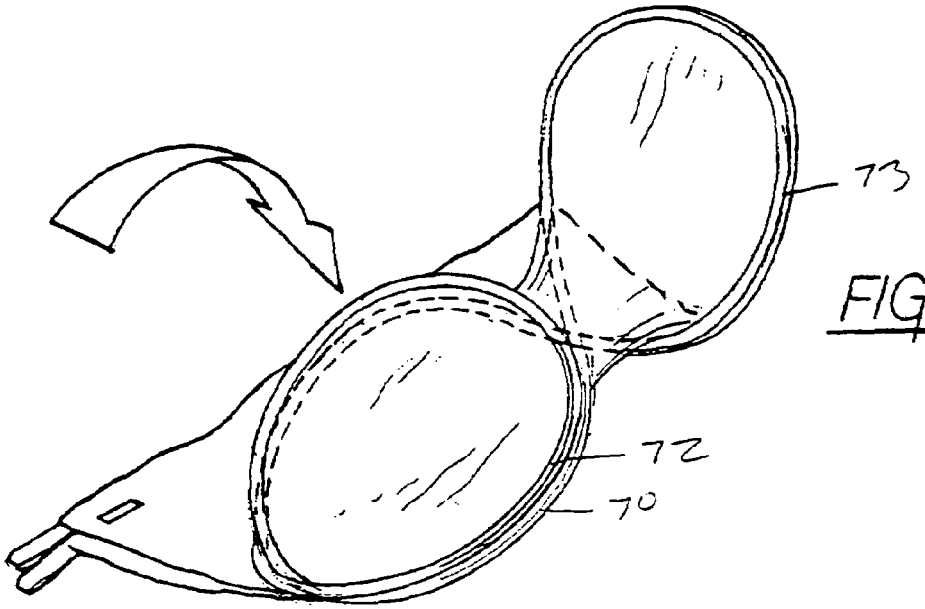
FIG-12
FIG-13
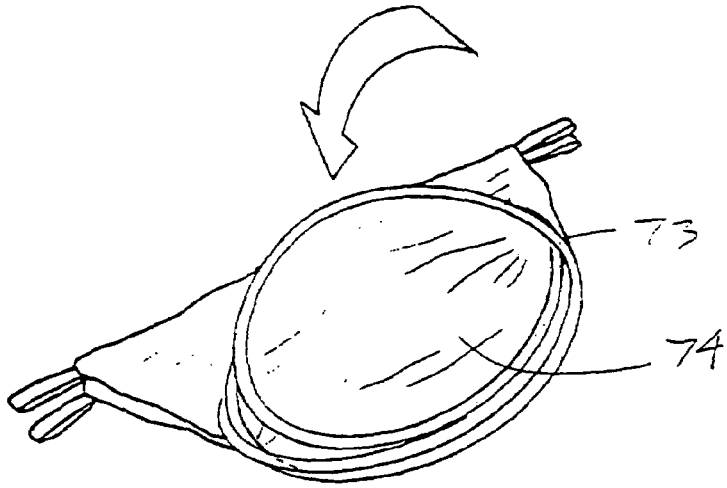
FIG-14
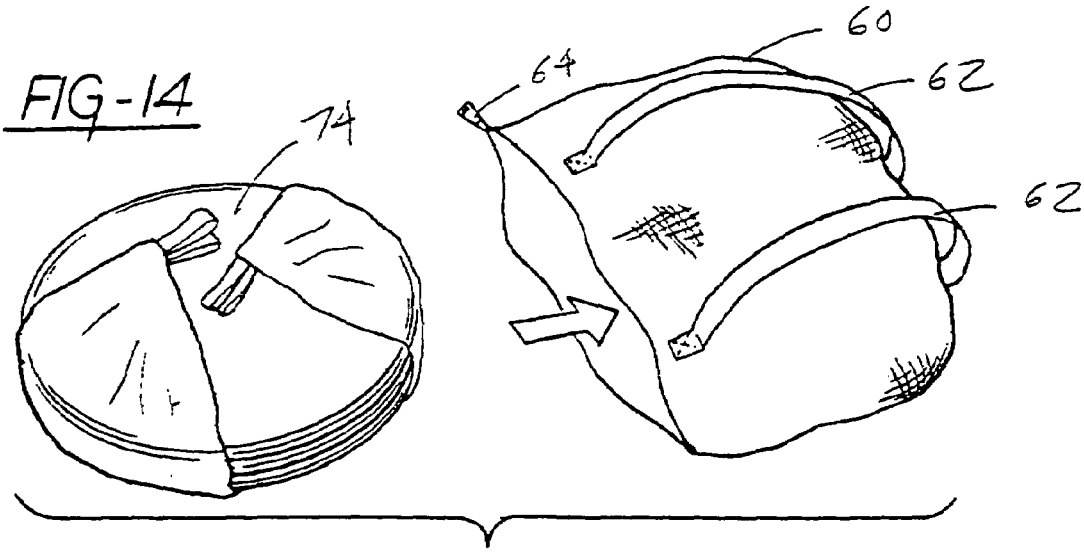

COLLAPSIBLE ENCLOSURE WITH INTERCHANGEABLE AND REVERSIBLE COVERING ELEMENTS

RELATION TO PRIOR PATENT APPLICATION

This application claims the benefit of Provisional Application Ser. No. 60/251,545 filed Dec. 7, 2000.

FIELD OF THE INVENTION

The invention pertains to portable and collapsible enclosures, such as tents, and more particularly, to such enclosures bearing camouflage or background-matching patterns.

BACKGROUND OF THE INVENTION

Portable enclosures, such as tents, have been used as blinds and shelters since the beginning of recorded time. The structure and appearance of such enclosures is as varied as human culture.

More recently, easily portable, lightweight, durable and affordable enclosures have become a desirable accessory for many outdoor recreational activities, including camping and hunting. The widespread availability of modern lightweight structures and fabrics has resulted in the proliferation of literally hundreds of new designs for portable enclosures. Among the many popular current styles for tents and hunting blinds are the so-called "collapsible" structures which utilize a spring-like framework which can be easily collapsed and folded for transportation and storage. Such popular designs are typified in, for example, U.S. Pat. No. 3,675,667 issued to Miller.

It is also well known to apply camouflage or background-matching patterns or colors to portable enclosures. It is desirable, particularly by hunters, that a tent or hunting blind be as inconspicuous as possible in its environment, and the development of realistic camouflage patterns for such enclosures (as well as other articles) has resulted in the widespread availability of enclosures which are almost invisible in specific backgrounds. For example, such enclosures may be provided with a typical woodlands camouflage pattern, in which the enclosure's fabric bears a depiction of typical mid-summer forest greenery, including the usual mix of deciduous and coniferous foliage, underbrush and grasses which might be found in a Midwestern woodland in summer. A type of camouflage popular among waterfowl hunters would feature the typical foliage and associated scenery of a fall wetlands area, including tall reeds, cattails, and related types of growth commonly found near water, appropriately shaded for autumn waterfowl hunting. Similarly, for the winter hunting season, camouflage materials are available which feature those mixtures of white and brown hues which would be commonly found in a snow-covered climate during winter. In certain hunting environments, it is desirable to have a bright, high contrast color, such as "Hunter's Orange" to make the enclosure more (instead of less) conspicuous in relationship to its background.

By producing these types of enclosures in readily collapsible styles, the hunter or outdoorsman has available a wide selection of enclosures containing desirable camouflage backgrounds for any geographic environment or season. The major drawback of this range of choices, however, is the necessity for the outdoorsman to acquire different enclosures for different geographic areas and different seasons. The hunter, for example, who wishes to participate in both a fall waterfowl hunting season and a winter small animal hunting season might, of necessity, own two different collapsible camouflage enclosures, one depicting appropriate camouflage for the waterfowl season and environment, and a second for the winter season. Likewise, hunters traveling to different geographic areas during the same season will desire different camouflage patterns based on the environment in which their activities will be conducted. A camouflage pattern suitable for July in Northern Michigan, for example, would be unsuited for use during the same season in a western state, such as in the Oregon high desert. From a practical standpoint, although lightweight, such collapsible enclosures do have a certain volume and mass, and it is inconvenient to transport several different enclosures at once.

What is needed then, is an adaptable enclosure which is readily convertible between one camouflage or background pattern and another, utilizing a common framework. Also desirable is the incorporation of two distinct camouflage or background marking patterns in a single covering which could be reversibly applied to a framework.

SUMMARY OF THE INVENTION

The invention, therefore, is a collapsible portable enclosure adapted to accept an array of different camouflage or background-marking coverings. Such coverings are readily interchangeable and may, in one embodiment, be reversible as well, providing to the user two separate camouflage or background-marking patterns in a single fabric covering. In one embodiment of the invention, one or more of a selection of fabric coverings may be applied over an existing enclosure, including both the frame and covering, to change the physical appearance of the enclosure. In another embodiment, the fabric covering may be easily removed from the enclosure's framework, and a different covering, or the reverse side of the first covering, may be substituted for the first covering, or a first outer surface of the first covering.

DESCRIPTION OF THE DRAWINGS

FIGS. 8 through 13 show the folding sequence of the enclosure.

FIG. 14 shows the folded enclosure in relation to its storage and carrying bag.

DETAILED DESCRIPTION OF THE INVENTION

Figure 1:
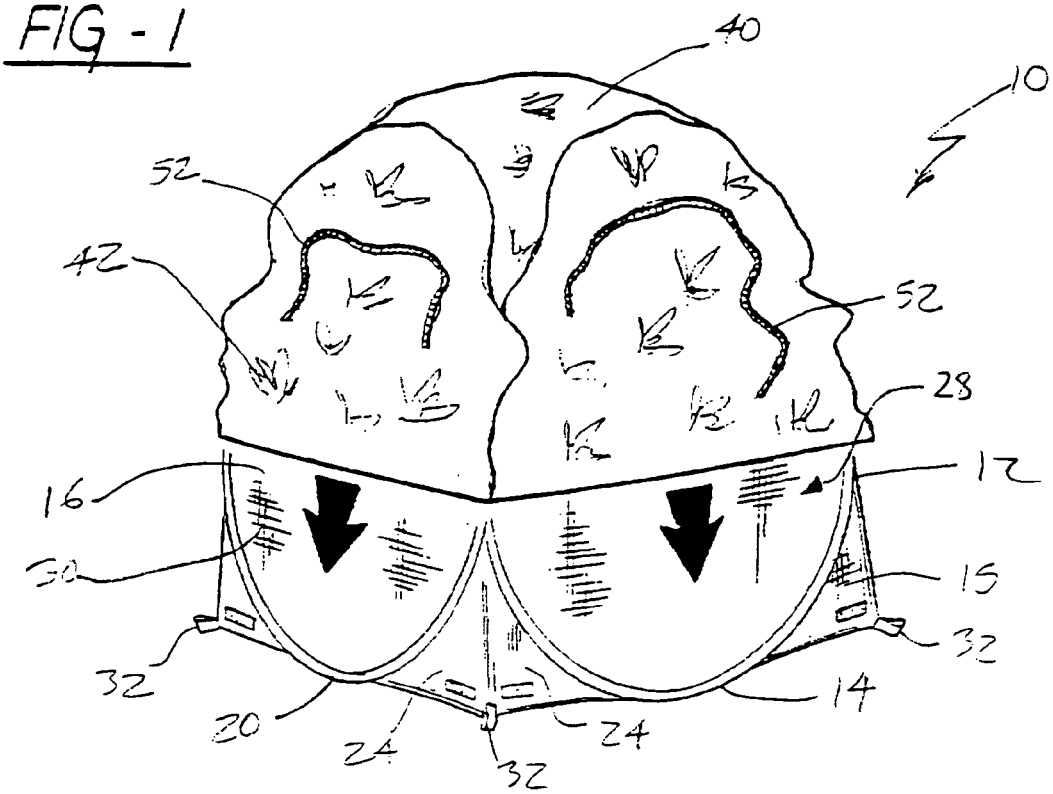
FIG. 1 is a perspective view of the invention showing the enclosure bearing its basic covering, and a secondary covering overlaid and removably attached to the first covering.
Figure 7:
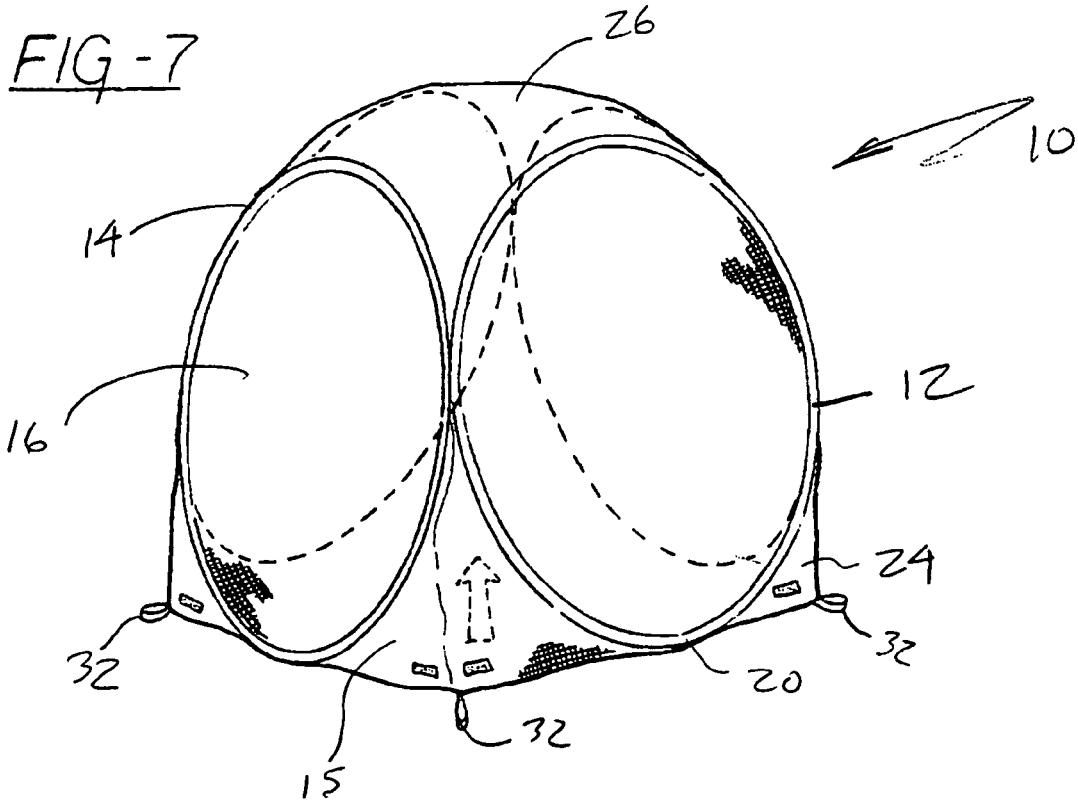
FIG. 7 is a perspective view of the enclosure showing the fully expanded position of the framework elements which support the enclosure.

One embodiment of the enclosure is designed with sufficient interior volume to accommodate one or more occupants. The overall dimensions of the enclosure are selected to insure the relative comfort of the occupants in the desired activity, which, by way of example in this application, is of a size suitable for hunting. The enclosure 10, as shown in FIG. 1 and FIG. 7, is supported by a plurality of frame members 12 surrounded by fabric. The frame members 12 are typically of a resilient or spring-like material, such as spring steel, which is strong and durable, yet lightweight. This embodiment the enclosure 10 is provided with a covering 15 which, in turn, is provided with closable ports, such as doors and windows, for the convenience of the occupant. While traditional fabrics such as Dacron or linen are typically used as the fabric covering, the invention may use other flexible non self-supporting materials, such as plastic sheeting, as the covering. Likewise, the enclosure is provided with a flexible floor (not shown), although the inclusion of a floor is not a requirement for all embodiments of the invention. Embodiments may be at least three-sided, yet may have four, five or more sides as may be desirable for the intended use of the invention. The frame members are restrained within sleeves 14 formed in the covering 15. The placement of the sleeves 14, and the dimensions of the side panels 16 which define the enclosure, further define the shape of the enclosure 10 and restrain the resilient frame 12 in a desired configuration when the enclosure 10 is fully erected.

Figure 2:
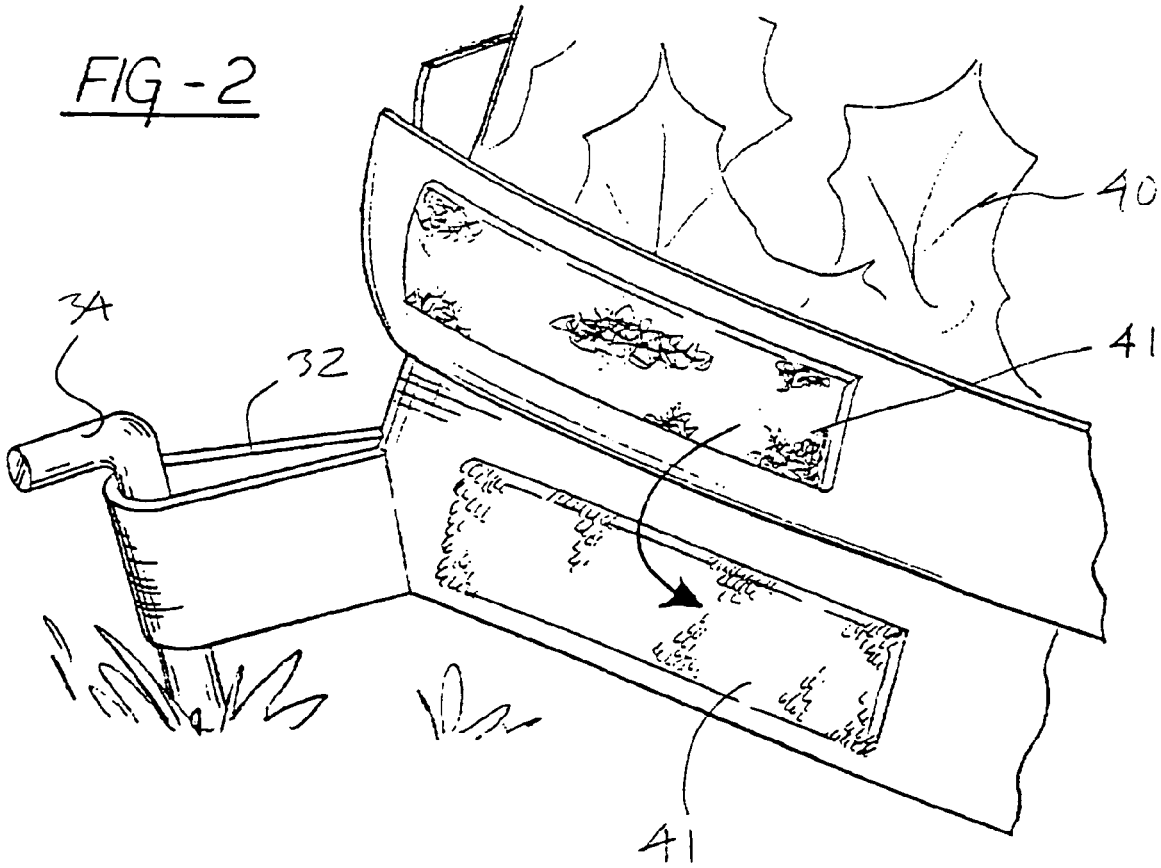
FIG. 2 shows one method of attaching the second covering to the enclosure.

A typical example of the enclosure 10 is shown in FIG. 1 and FIG. 7, and includes a one or more continuous resilient frame members 12 which are contained within sleeves 14 sewn or otherwise formed in the perimeter of collapsible side panels 16 of the enclosure. In the fully erected state, the tension provided by the frames 12 against the sleeves 14 likewise asserts tension against the fabric side panels 16 of the enclosure, urging the side panels 16 of the enclosure 10 into the shape defined by the perimeter of the side panels 16 and the associated sleeve 14. In this embodiment, the fabric side panels 16 are formed into ovoid shapes by the ovoid shape of the side panel material, and the sleeves 14 attached to the perimeter of said side panels 16. By placement of a resilient frame member 12 within the sleeve 14, the ovoid shape of each side of the enclosure is obtained. Once each side panel 16 of the enclosure is expanded and subject to the tensioning provided by the resilient frame member 12, a multi-sided enclosure is thereby created which obtains its stability as the bottom apex 20 of each ovoid frame contacts the ground. The side panels 16 of the enclosure are joined together by filler sections 24, and top section 26 which, in conjunction with side panels 16, create a complete enclosure. In this embodiment, each corner of the enclosure 10 is likewise provided with a stake loop 32 and stake 34 to allow temporary affixation of the enclosure 10 to the ground on which it is erected as shown in FIG. 2. The enclosure 10 will typically have at least three, and preferably four side panels 16, although more than four side panels may also be incorporated into the device.

Figure 6:
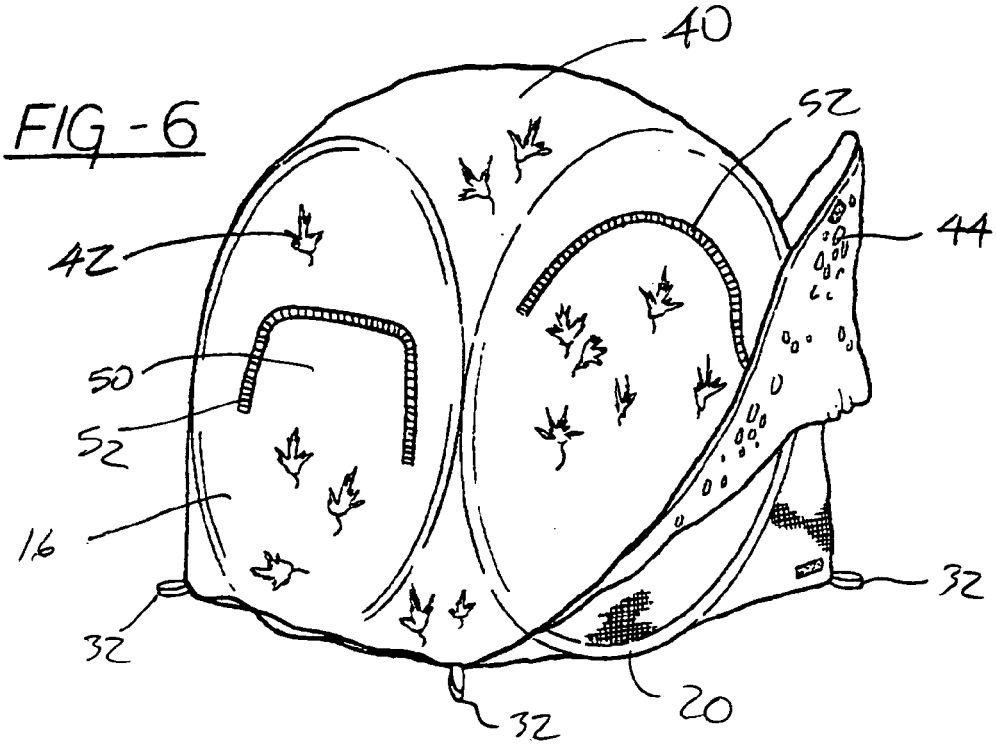
FIG. 6 is a perspective view of the invention showing an enclosure bearing its basic covering, and a secondary, reversible covering overlaid and removably attached to the first covering.

Also, as shown in FIG. 1, a first surface 28 of the covering 15 of the enclosure is woven or printed with a first desired color, camouflage or background-matching pattern 30 suited to the environment in which the enclosure 10 will be used. In a first embodiment of the invention, this first covering 15, from which the sides of the enclosure 10 are formed, is permanently attached to the frame members 12 by capturing sleeves 14 which surround the side panels 16 of the enclosure. Additionally, in a second embodiment of the invention, the enclosure 10 includes a second removable covering 40 bearing a second camouflage pattern 42. The covering 40 is manufactured in a size which is only slightly larger than the outside dimension of the erected enclosure 10. In this fashion, the covering 40 bearing a second camouflage pattern 42 may be drawn over the exterior of the enclosure 10, much as a glove is drawn over a hand, providing a new and secondary covering for the enclosure 10. In this embodiment, the covering 40 bears a color, camouflage or background-matching pattern 42 which is different from the color, camouflage or background or matching pattern of the underlying enclosure. In another embodiment of the invention as shown in FIG. 6, the covering 40 is reversible, bearing a third camouflage pattern 44 on the side of the covering opposing the second camouflage pattern 42, thereby allowing the occupant to reverse the covering 40 and apply yet a third camouflage pattern 44 to the enclosure. To secure the covering 40 to the exterior of enclosure 10, covering 40 and covering 15 are provided with hook and loop type fasteners 41, or similar fasteners such as snaps, buttons or zippers, as shown in FIG. 2.

Figure 3:
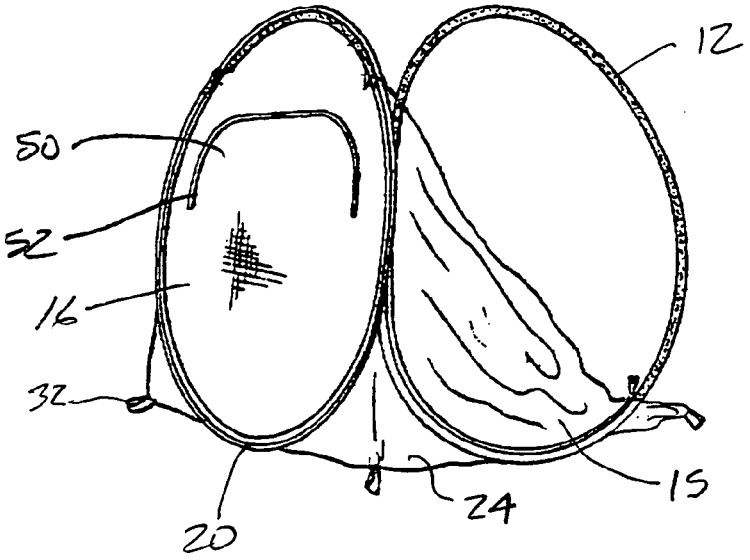
FIG. 3 shows a second embodiment of the invention, in the form of a framework, bearing a removable, reversible enclosure.
Figure 4:
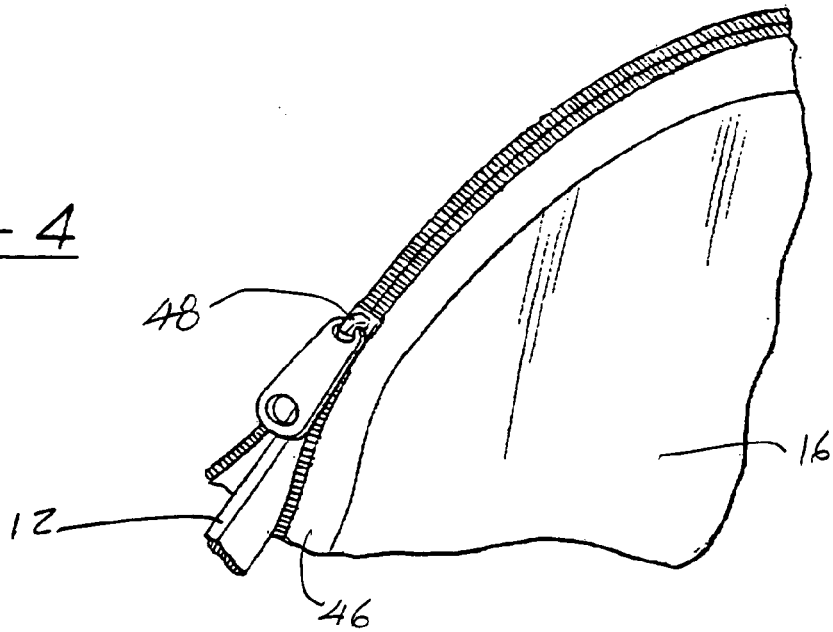
FIG. 4 shows the attachment of the removable covering of the second embodiment, and its method for reversal.

In yet another embodiment of the invention as shown in FIGS. 3 and 4, the fabric forming the covering for the enclosure is provided with reclosable sleeves 46 which allow removal of the resilient frame members 12 from the enclosure 10. This allows utilization of the frame members 12 independent from the covering 15, so that the same resilient frame members 12 can be placed within the sleeves 46 of a variety of different coverings 15 bearing a variety of different camouflage patterns. Utilizing this method, the outdoorsman may carry the frame members 12 for the enclosure 10, and a plurality of fabric coverings 15, which may be installed upon the frame members at will, providing to the occupant of a wide variety of different camouflage patterns for different environments and seasons. As with other embodiments, in this embodiment of the invention, each covering may be reversible, so that one covering provides two discrete camouflage patterns to the user.

The reclosable sleeves 46 above-described may be provided with any of a variety of conventional and well known closure means, such as zippers 48, Velcro™, snaps, buttons or the like. By the utilization of this type of closure, it is possible to selectively and repeatedly open and close the sleeves 46 surrounding the side panels 16 of the enclosure for insertion and removal of the resilient frame members 12. In the several embodiments of the invention, it is preferable to provide each of the side panels 16 with one or more ports 50, such as windows or doors, which are also provided with closures such as zippers, Velcro, snaps, buttons or the like. These ports permit ingress and egress to the occupant, as well as viewing of the area outside the enclosure, the firing of weapons, or the utilization of photographic equipment. The use of reversible closures, such as reversible zippers, on the ports 50 of the enclosure 10 insures the utility of such ports 50 regardless of which side of the covering is outermost.

Figure 5:
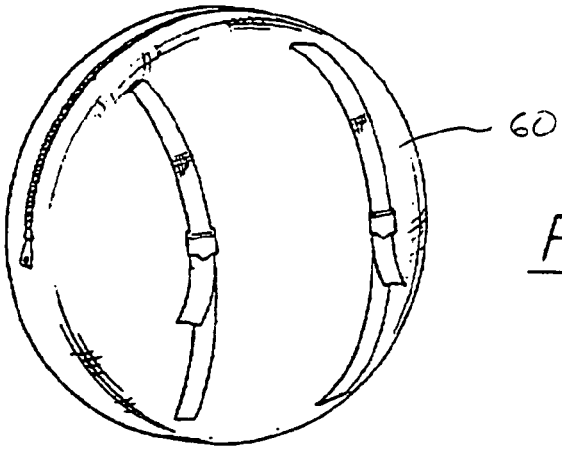
FIG. 5 shows the container for the enclosure and its associated additional coverings.

In the collapsed state, the enclosure 10 fits conveniently within a container 60 for transport, as shown in FIG. 5.

Figure 8:
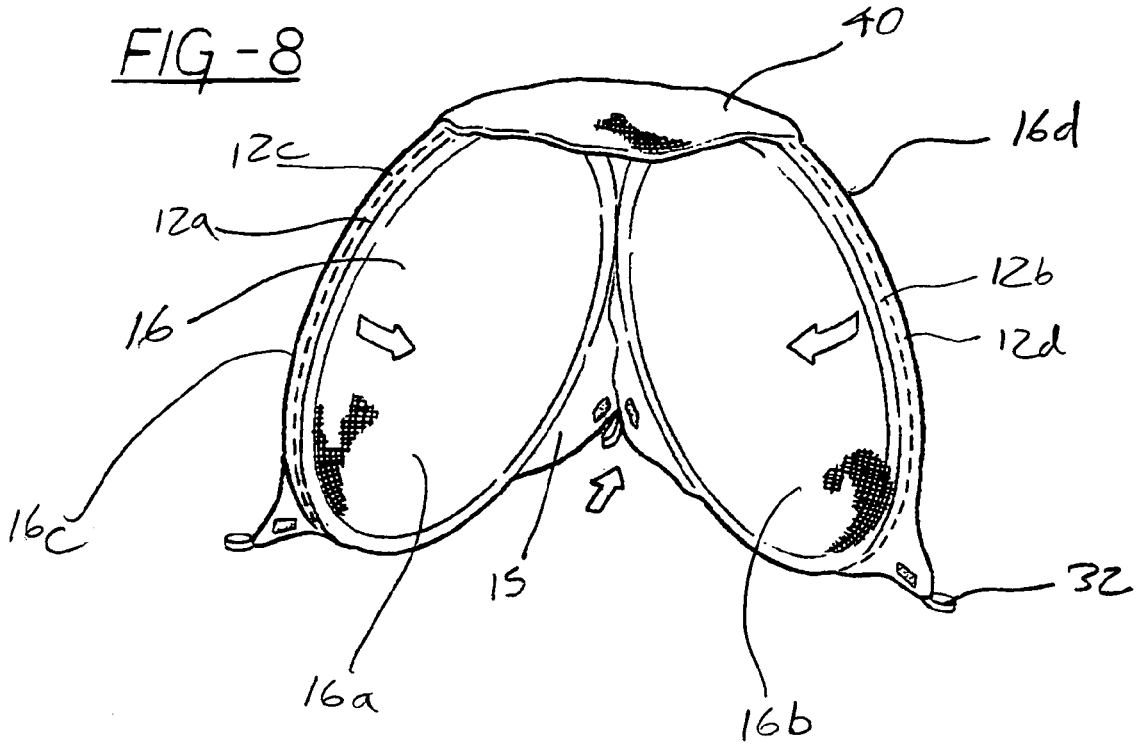
Figure 9:
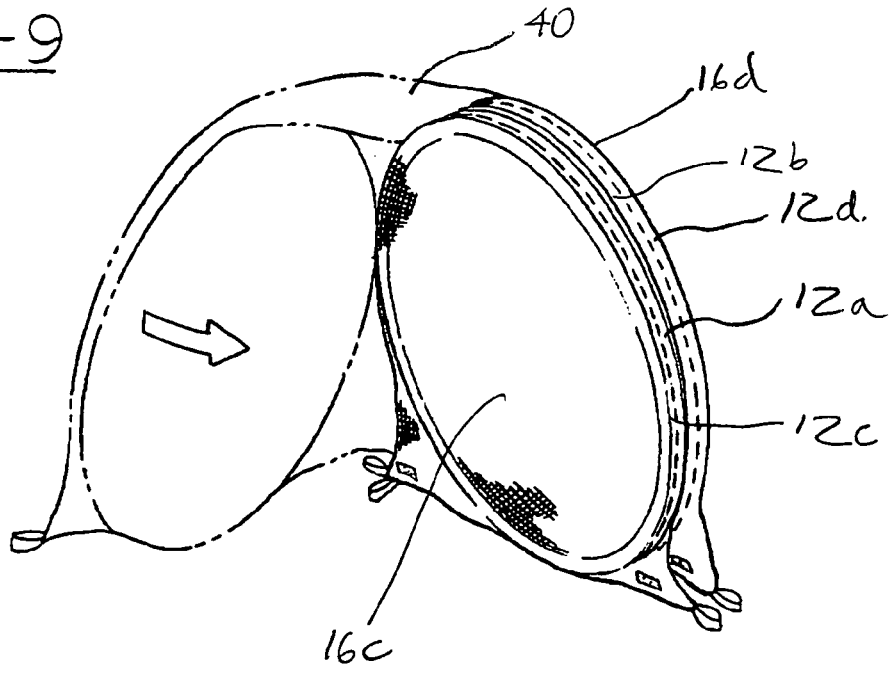
Figure 10:
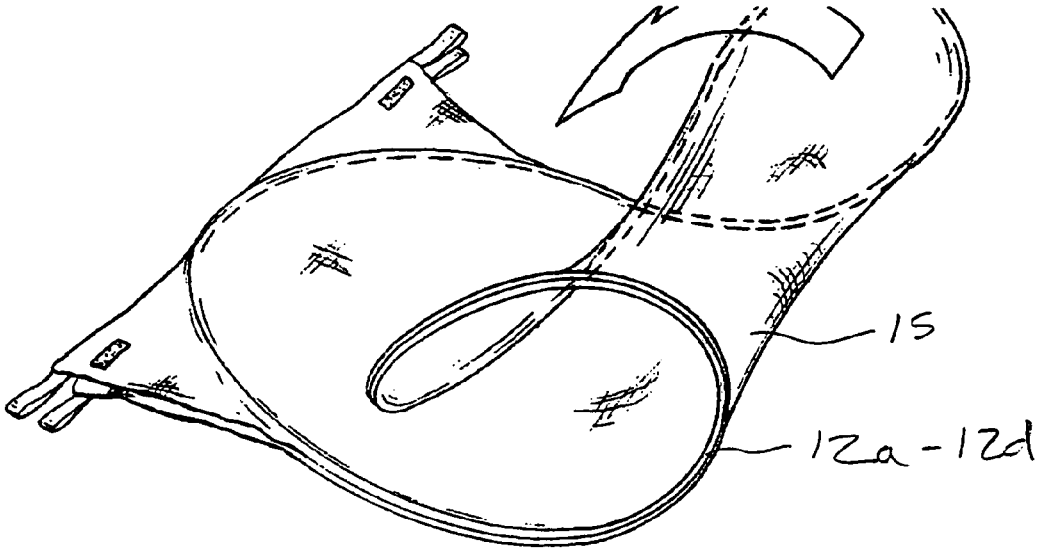
Figure 11:
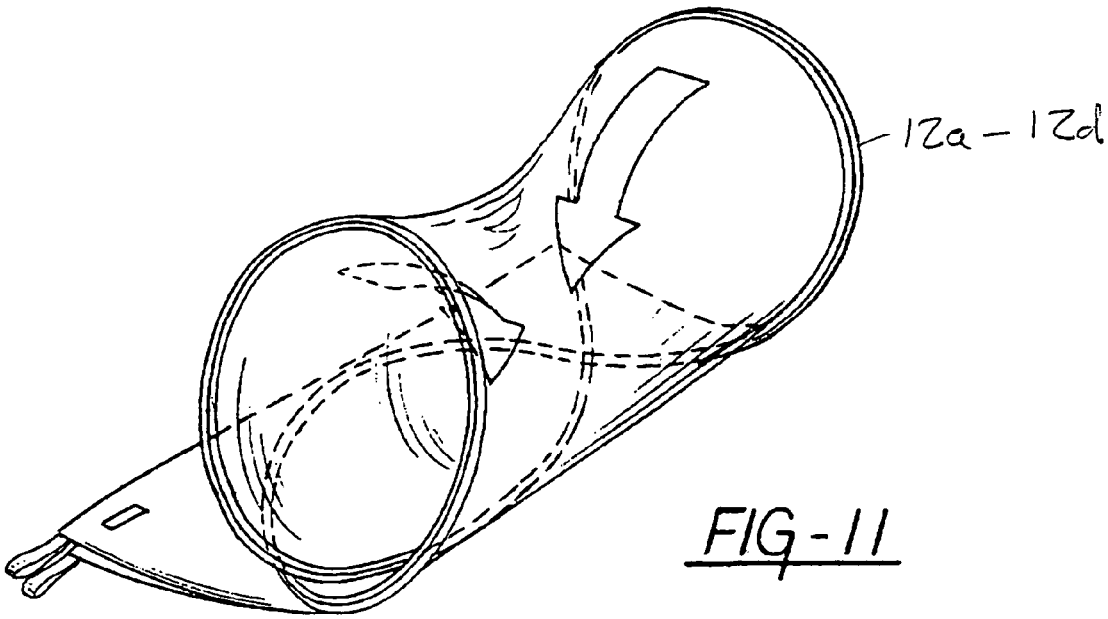

The collapsing of the enclosure frame is accomplished as shown in FIG. 7 through FIG. 13. This process can be performed with the frame 12 alone, with the frame covered by fabric covering 15, or with the frame covered by a fabric covering 15 and one or more coverings 40. In the embodiment shown in FIG. 7, the enclosure 10 comprises four side panels 16 surrounding frame members 12, and erected in such a fashion as to present a quadrilateral enclosure having a top section 26. Inasmuch as the material of the covering 15 is flexible, the enclosure 10 may be flattened, as shown in FIG. 8 by urging side panel 16*a* against side panel 16*c* and side panel 16*b* against side panel 16*d*. In this configuration, the frame member 12*a* surrounding side panel 16*a* is brought into contact with frame member 12*c* surrounding side panel 16*c* and frame element 12*b* surrounding side panel 16*b* is brought into contact with frame element 12*d* surrounding side panel 16*b*. Thereafter, as shown in FIG. 9, side panels 16*a*, frame member 12*a*, side panel 16*c* and frame member 12*c* are folded in the direction of the arrow, thereby stacking side panels 16*a* through 16*d* against one another, thereby bringing into superimposed contact frame members 12*a* through 12*d*. Next, as shown in FIG. 10, simply twisting the stack of superimposed frame members into a U-shaped configuration initiates the folding process. A second twist as shown by the arrow in FIG. 11 results in the formation of three overlapping coils of resilient material each having a substantially smaller diameter than the diameter of the frame members above-described. The three coils 70, 72, and 73 are shown in FIG. 12. When the three coils 70, 72, and 73 are superimposed, they form a compact package 74 which may be easily transported, as shown in FIGS. 13 and 14. In the preferred embodiment, the invention is provided with a container 60 adapted to enclose and restrain the collapsed enclosure or framework. The container 60 may be provided with one or more pockets (not shown) in which to store one or more coverings 40. Further, the container may be provided with shoulder straps 62 and a closure 64 to facilitate carrying. In this fashion, the user may conveniently carry the framework, the principal enclosure, and/or the framework, principal fabric covering and a plurality of additional coverings.

The invention claimed is:

1. In a man-portable, tent-like enclosure having a shape defined by a frame with an enclosure exterior surface connected thereto, and the enclosure exterior surface bearing a first camouflage pattern, the improvement comprising:

a non self-supporting covering removably disposable over said enclosure exterior surface so as to be supported by said enclosure, said covering bearing a second camouflage pattern on a first covering surface, said second camouflage pattern being different from said first camouflage pattern, said covering having a second covering surface opposing said first covering surface, and said covering having a shape closely conforming to the shape of the portable enclosure so as to surround and cover substantially all of said enclosure exterior surface.

2. The invention of claim 1, wherein said covering bears a third camouflage pattern on said second covering surface, said third camouflage pattern being different from said first and second camouflage patterns, and wherein further said covering is reversible so that the second covering surface is selectively visible from the exterior of the portable enclosure.

3. The invention of claim 1, wherein said enclosure exterior surface comprises a two-sided flexible material removably attached to said frame.

4. A portable enclosure comprising a collapsible frame characterized in that it tends spontaneously from a collapsed condition to an erected condition thereof, and a flexible, non self-supporting covering substantially surrounding said frame to thereby define a walled enclosure, said flexible covering removably attached to said frame and having an interior surface and an exterior surface, said exterior surface bearing a first visible pattern and a further non self-supporting covering removably disposable over said enclosure covering so as to be supported by said enclosure, said removable covering bearing a second visible pattern on a first covering surface, said second visible pattern being different from said first visible pattern, said further covering having a shape closely conforming to the shape of the portable enclosure so as to surround and cover substantially all of said enclosure.

5. The invention of claim 4, further comprising said interior surface bearing a second visible pattern, and said flexible covering being reversibly attachable to said frame, so that the second visible pattern is selectively visible from the exterior of said portable enclosure.

6. An apparatus, comprising:

A man-portable, tent-like enclosure having a shape defined by a frame with an enclosure exterior surface connected thereto; and a flexible covering removably reversibly disposable over said enclosure exterior surface so as to be supported by said enclosure, said covering bearing a first camouflage pattern on a first covering surface, said covering having a second covering surface opposing said first covering surface, said second covering surface bearing a second camouflage pattern thereon which is different from said first camouflage pattern, and said covering adapted to surround and cover substantially all of said enclosure exterior surface wherein said enclosure exterior surface bears a third camouflage pattern thereon which is different from either of the first or second camouflage patterns.

7. The portable enclosure of claim 4, wherein said removable covering has a second covering surface opposite said first covering surface, said second covering surface bearing a third visible pattern that is different from either of said first and second visible patterns, and wherein said further covering is reversible so that the second covering surface is selectively visible from the exterior of the portable enclosure.

* * * * *